US008915055B2

(12) United States Patent
Stephan et al.

(10) Patent No.: US 8,915,055 B2
(45) Date of Patent: Dec. 23, 2014

(54) SPINNING MACHINE AND A PROCESS FOR REMOVING AN END SECTION OF A YARN OF A SPINNING MACHINE PRIOR TO A SUBSEQUENT PIECING PROCESS

(75) Inventors: Adalbert Stephan, Beilngries (DE); Josef Ludvícek, Ústi Nad Orlicí (CZ); Gernot Schäffler, Wäschenbeuren (DE)

(73) Assignee: Maschinenfabrik Rieter AG, Winterthur (CH)

( * ) Notice: Subject to any disclaimer, the term of this patent is extended or adjusted under 35 U.S.C. 154(b) by 189 days.

(21) Appl. No.: 13/616,912

(22) Filed: Sep. 14, 2012

(65) Prior Publication Data

US 2013/0067879 A1 Mar. 21, 2013

(51) Int. Cl.

| | |
|---|---|
| ***D01H 15/00*** | (2006.01) |
| ***D01H 1/24*** | (2006.01) |
| ***D01H 5/68*** | (2006.01) |

(52) U.S. Cl.

CPC ..... *D01H 1/24* (2013.01); *D01H 15/00* (2013.01); *D01H 5/68* (2013.01)

USPC ..... 57/261

(58) Field of Classification Search

CPC ..... D01H 1/24; D01H 4/48; D01H 5/68; D01H 13/14; D01H 13/1691

USPC ..... 57/22, 202, 261, 263, 264; 242/475.1, 242/475.2, 475.4, 475.6

See application file for complete search history.

(56) References Cited

U.S. PATENT DOCUMENTS

| | | | | | |
|---|---|---|---|---|---|
| 4,845,936 | A * | 7/1989 | Artzt et al. | ..... | 57/261 |
| 4,944,145 | A * | 7/1990 | Stahlecker | ..... | 57/261 |
| 5,163,279 | A * | 11/1992 | Stahlecker | ..... | 57/86 |
| 5,167,114 | A * | 12/1992 | Stahlecker | ..... | 57/261 |
| 5,327,712 | A * | 7/1994 | Dallmann et al. | ..... | 57/22 |
| 5,484,116 | A * | 1/1996 | Horak et al. | ..... | 242/475.6 |
| 5,813,209 | A | 9/1998 | Hirao et al. | | |
| 6,666,012 | B2 | 12/2003 | Widner et al. | | |
| 7,464,529 | B2 * | 12/2008 | Stahlecker et al. | ..... | 57/263 |

FOREIGN PATENT DOCUMENTS

| | | |
|---|---|---|
| DE | 102 33 572 A1 | 3/2003 |
| DE | 10 2008 000 239 A1 | 8/2009 |
| DE | 20 2009 011 586 U1 | 3/2010 |
| GB | 2059454 | 4/1981 |

OTHER PUBLICATIONS

German Patent Office Search Report, Mar. 19, 2012.

* cited by examiner

*Primary Examiner* — Shaun R Hurley
(74) *Attorney, Agent, or Firm* — Dority & Manning, P.A.

(57) ABSTRACT

The spinning station of a spinning machine includes a yarn end disposal means, arranged between the outlet of the spinning device and the winding device, and with the aid of which an end section of the produced yarn is separated from the rest of the yarn and eliminated. Furthermore, a process for removing an end section of a yarn at a spinning station of a spinning machine prior to the subsequent piecing process is proposed, wherein the end section is gripped, cut off, and subsequently eliminated from the area of the spinning station with the aid of a yarn end disposal means arranged between the outlet of the spinning device and the winding device.

21 Claims, 7 Drawing Sheets

SPINNING MACHINE AND A PROCESS FOR REMOVING AN END SECTION OF A YARN OF A SPINNING MACHINE PRIOR TO A SUBSEQUENT PIECING PROCESS

FIELD OF THE INVENTION

The present invention relates to a spinning machine having at least one spinning station, wherein the spinning station has a spinning device with an inlet for a fibre material and an outlet for the yarn produced from the fibre material in the spinning device. The machine includes a feeding device for feeding the fibre material into the spinning device and a winding device for winding of the produced yarn. Furthermore, a process for removing an end section of a yarn at a spinning station of a spinning machine prior to a subsequent piecing process is disclosed, wherein the spinning station includes a spinning device comprising an inlet station for a fibre material and an outlet station for the yarn produced from the fibre material in the spinning device, a feeding device for feeding the fibre material into the spinning device and a winding device for winding of the produced yarn. Subsequent to an interruption of the spinning process, at least the yarn end section to be eliminated is unwound by the winding device.

BACKGROUND

During the spinning process, spinning machines (for example a rotor or air jet machine) will often stop during yarn production, either intentionally or unintentionally. The yarn end that arises out of these production stops (for example because of a quality cut or a yarn break), will be wound onto the still-rotating bobbin of a winding device. For the purposes of the piecing process, the yarn end located on the bobbin must be released from the bobbin surface, for example with the aid of a suitable suction device, in order to be able to feed the yarn end in the actual spinning direction back towards the spinning station. Furthermore, as a rule, a defined section of the yarn must be removed prior to the piecing process, as the existing yarn end is usually not suitable. As a result, a significant delay occurs in continuing the spinning process, in particular because the locating of the yarn and the subsequent removal of the end section is primarily carried out by a service robot, which has to be driven to the respective spinning station.

It is an object of the present invention to propose a spinning machine, as well as a process for removing a yarn end section in a spinning machine prior to a subsequent piecing process, wherein with the aid of the present invention, the piecing time is reduced in comparison to prior art. Additional objects and advantages of the invention will be set forth in part in the following description, or may be obvious from the description, or may be learned through practice of the invention.

According to the present invention, the spinning station includes a yarn end disposal means, which is at least partly arranged between the outlet station of the spinning device (including for example a spinning nozzle or a spinning rotor) and the winding device, and with the aid of which the end section of the produced yarn is able to be cut from the rest of the yarn and eliminated. The removal of the yarn section not suitable for the piecing device can thus be carried out directly at the spinning station, namely prior to the arrival of a service robot or or service personal at the respective spinning station.

If an interruption in the spinning process occurs, for example in the context of a quality cut (which is intentionally carried out when one or a number of the monitored yarn parameters do not correspond to the nominal values), or an unplanned yarn break, preparations for the yarn for the subsequent piecing process can begin directly after the interruption. While it is usually necessary after a yarn break to release the yarn end from the bobbin surface and subsequently feed it to the yarn end disposal means (for example by means of a separate gripping device), the design of the spinning station according to an embodiment of the present invention opens up enormous advantages, in particular for the execution of the quality cut. It is in principal possible to slow down the production of yarn subsequent to the detection of a deviation from a previously defined yarn parameter. In this case, it is conceivable to gradually reduce the transport speed of the delivery device, the winding arrangement and if present, the withdrawal device, with which the yarn is withdrawn from the spinning device. Subsequent to a predetermined reduction of the respective transport speeds, an interruption of the yarn production occurs, as the feed speeds fall below the minimal values which should be maintained for yarn production. The term quality cut does not therefore essentially imply a cutting process. Rathermore, an interruption of the spinning process is implied, which is introduced because of irregularities of defined yarn parameters.

If, then, the passing of the yarn end at a certain point (for example at the outlet station of the spinning device) is detected by, for example, a monitoring unit arranged outside of the spinning device, the above-mentioned units (feed device, winding device, withdrawal device) can be completely stopped. The yarn end is now located at a defined position and, if required, can be affixed accordingly, for example with the aid of a roller pair of the withdrawal device. If the yarn end is fixed in the area of the yarn end disposal means according to aspects of the present invention, the yarn end can be reliably gripped by the yarn end disposal means without any further handling devices being necessary. Subsequent thereto, the end section of the yarn which does not meet the specifications is wound on by the winding device, wherein in the case of a slowing down of the feed speeds, the end section should advantageously correspond to the end section which was produced at the start of the slow-down. The wound-on end section can, for example, be wound on or suctioned by the yarn end disposal means and then cut off and accordingly eliminated (for example in the area of a central collecting area).

When the service robot approaches the area of the spinning station, a suitably prepared yarn end is already present, which can be fixed at a predetermined station, advantageously in the area of an outlet of the yarn end disposal means. Consequently, the robot does not have to search for the yarn end on the surface of the winding device and to unwind it, as is the case in prior art. The time-consuming removal by the robot of the above mentioned end section of yarn, which is no longer suitable for the piecing process, is also omitted. As a result, the time required by the robot for the piecing process is significantly reduced.

Furthermore, it is advantageous when the yarn end disposal means includes a suction channel, by means of which the end section of the yarn is able to be sucked in and/or the cut off end section is able to be eliminated. The suction channel can be connected to a central vacuum source of the spinning machine. It is of course also conceivable to equip the suction channel with its own vacuum source, for example a Venturi nozzle, which is only then put into operation when a yarn end section has to be removed at the respective spinning station.

It is particularly advantageous when the yarn end disposal means includes a cutting unit, with the aid of which the end section to be removed is able to be separated from the rest of the yarn. In particular, when the cutting unit is integrated in the above mentioned suction channel, the result is a compact unit, with the aid of which the end section to be removed is not only able to be separated but also removed, that is, disposed of. The cutting unit can, when required, be brought into the proximity of the end section of the yarn and/or be activated or deactivated.

Alternatively, it is of course understood that it is possible to apply the yarn-cutting device of a yarn-monitoring unit ("clearer"), which if required, can also be designed as a cutting unit. The yarn-cutting device is, in this case, advantageously positioned between the suction channel of the yarn end disposal means and the withdrawal device, and monitors predetermined characteristics and the presence of produced yarn in the area of the yarn-monitoring unit. A separate cutting device within the suction channel could be omitted in this embodiment.

It is also advantageous when the spinning station comprises a withdrawal device, formed for example by a withdrawal roller pair, for the withdrawal of the yarn out of the spinning device, wherein the yarn end disposal means is arranged between the spinning device outlet and the withdrawal device. As already implemented, it is in principal possible to selectively slow down the spinning station for carrying out a so-called quality cut until the feed speed, in particularly that of the feed device, slows down to such an extent that an interruption of the yarn production occurs. The yarn end which occurs as a result can, if required, be fixed between the roller of the withdrawal device, wherein the fixing, that is the associated halt of the withdrawal rollers, can be initiated by a sensor, which monitors the presence of a yarn at a defined station downstream of the outlet of the spinning device.

The withdrawal rollers release the yarn end again, before the yarn end is gripped by the yarn lead-away and is, for example, sucked into the suction channel (under the action of a corresponding reverse rotation of the bobbin supported in the winding device.) Alternatively, it is also possible to fix the yarn constantly between the withdrawal rollers, wherein the withdrawal rollers also execute a reverse turn according to the rotational direction of the winding device (that is, a reverse turn in the opposite rotational direction to that during the actual spinning process), as long as the end section of the yarn is wound off the winding device. The advantage herein lies in the fact that the yarn end is also still fixed by means of the withdrawal device at a defined station when the end section of the yarn is separated from the yarn end disposal means and removed. The robot, which arrives if required, can selectively grip the yarn end prior to the actual piecing process, so that the time loss caused by searching for the yarn end is avoided.

There are particular advantages when the winding device and/or (each) withdrawal device comprises a reversibly drivable drive unit. Even if it were sufficient to equip the mentioned units with a free running device for the winding off of the yarn section to be removed, it is advantageous when an active drive against the transport direction prevailing during the spinning process is possible. In this way, a controlled winding off of the end section of the yarn is possible, wherein a non-defined after-running of the respective bobbin can be avoided.

There are also advantages when the spinning machine comprises a number of adjacently arranged spinning stations, wherein each spinning station includes a separate yarn end disposal means. The spinning stations are independent of one another, so that at each spinning station where a piecing process is to take place, the respective end section of the yarn, which is unsuitable for piecing, can be removed.

It is particularly advantageous when the suction channel of the yarn end disposal means is connected to a suction device of the feed device. Suction devices of this type are usually present in the area of the drafting unit of an air jet spinning machine which forms the feed device, or of an opening roller of a rotor spinning machine, the suction devices serving to eliminate lint, dust and other impurities. If the suction channel is coupled with a suction device of this type, a separate suction device can be omitted. The connection between the suction channel and the suction device of the feed device can for example be made by means of pipe fittings and/or a flow diverter.

It is also advantageous when a valve and/or a flow diverter is assigned to the suction channel, with the aid of which the air pressure inside the suction channel is able to be regulated. The suction channel can be coupled with a central suction installation. Depending on whether or not it is necessary for the end section of yarn unsuitable for piecing to be removed at the respective spinning station or not, the suction channel is subject to low pressure, or respectively, an airstream which effects a sucking-in of the yarn end. The valve, or respectively, the flow diverter is advantageously controlled with the aid of a suitable controlling device, which in turn can, for example, be connected to a yarn sensor.

It is most advantageous when the winding device includes a yarn-traversing device, wherein a yarn-lifting device is assigned to the yarn-traversing device, with the aid of which yarn-lifting device the yarn is able to be brought out of the effective range of the yarn-traversing device. By lifting the yarn, breaking of the yarn or damage to the traversing device is prevented during the winding process of the yarn end section from the winding device, as yarn and traversing device no longer come into contact during this phase.

It is also advantageous when the yarn-lifting device includes a lifting element that is movable in relation to the yarn, the lifting element being advantageously aided by a pneumatic cylinder. The yarn runs via the lifting element and can no longer come into contact with the traversing element of the traversing device. At the latest when the piecing process is completed, the yarn-lifting device or respectively, the pneumatic cylinder, returns to its starting position, in which the traversing element effects a traversing motion of the yarn while the yarn is being wound off the winding device.

It is in addition advantageous when the lifting element extends at least over the width of the winding device. This ensures that the yarn is reliably gripped by the lifting element when the lifting element is activated. A movement of the lifting element in the width direction of the winding device (that is in axial direction of a placed bobbin) is therefore not necessary. The lifting device can herein for example be rod-shaped and connected to a respective driving element, for example the above-mentioned pneumatic cylinder.

Alternatively it is self-evident that provision can be made for the applied yarn-traversing device to comprise one or more traversing elements (for example in the form of a yarn guide), which, if required, are movable, swivel-mounted or otherwise movable in such a way that they are able to be placed in a position in which they do not come into contact with the yarn during the winding off of yarn (from the winding device). For example, it is conceivable that in this connection a so-called flyer traversing device could be applied. A flyer traversing device typically includes two or more counter-rotatable flyer elements, which alternately come into contact with the yarn to be wound on and move the yarn to and fro accordingly during winding on. In order to prevent the traversing element from coming into contact with the yarn during the winding off process (this could have a negative effect on the winding off process), it can be provided that the respective traversing elements are moved into a so-called winding off position. The winding off position is a position in which the traversing element, or respectively, the traversing elements, can no longer come into contact with the yarn which is running between the winding device and the withdrawal device. If the so-called flyer elements are applied, they would be rotated in a position in which the sections which come into contact with the yarn during winding off are located in an area, which during winding off are located outside of the yarn running path.

According to additional aspects of the present invention, the process for discharging an end section of a yarn in a spinning machine prior to a subsequent piecing process is characterized in that the end section of the yarn is wound off from the winding device subsequent to an interruption of the spinning process, and in that the end section is gripped with the aid of a component part of the spinning station in the form of a yarn end disposal means, then separated from the rest of the yarn and subsequently discharged from the area of the spinning station, wherein the yarn end disposal means is arranged at least partly between the outlet of the spinning device and the winding device. Each individual yarn can therefore be treated accordingly at each spinning station before a service robot or the relevant service personnel for carrying out the piecing process arrives. In addition, the yarn end is located at a defined place subsequent to the removal of the end section of the yarn unsuitable for the piecing process, namely advantageously in the area of the yarn end disposal means, and can if required (as mentioned above) be fixed thereto. The yarn end disposal means can be designed according to one or a number of the features described above, wherein this is not absolutely necessary.

It is advantageous in particular when the spinning station includes a withdrawal device for withdrawing the yarn from the spinning device, wherein the transport speeds of the delivery device, the withdrawal device, and the winding device can all be gradually reduced to a standstill prior to winding off the end section of the yarn. The reduction takes place advantageously in such a way that the end of the produced yarn is located between the outlet of the spinning station and the winding device, advantageously between the outlet of the spinning station and the withdrawal device, subsequent to the reduction. Advantageously, at least one section of the yarn end disposal means extends in this area (for example the suction channel). The yarn end resulting from the reduction of the delivery speeds is located in this case subsequent to the standstill of the above mentioned units at a defined place and can be gripped reliably by the yarn end disposal means, for example by means of suction. A backwards feed of the yarn, which is already wound onto the winding device, then takes place until the designated end section is taken up by the yarn end disposal means.

Subsequently, the end section is cut off and disposed of (for example via a suction installation of the spinning machine which is connected to the suction channel). If the yarn was gripped continuously by relevant withdrawal rollers of the withdrawal device, subsequent to the winding off of the yarn and during the removal of the end section of the yarn, the yarn generated by the removal of the yarn end section is thus located also in the area of the withdrawal device. This yarn end can now be selectively gripped by a service robot or by a member of the service personnel and fed to the subsequent piecing process.

It is also advantageous when the end section of the yarn to be removed is sucked up with the aid of a suction channel of the yarn end disposal means and is removed subsequent to separation from the rest of the yarn. Relevant suction channels are known from other parts of the spinning machine and can be subjected individually to low pressure by means of the relevant structural or computer-controlled measures.

It is particularly advantageous when a valve and/or a flow diverter is arranged to the suction channel and when, with the aid of the valve and/or the flow diverter, the air pressure can be regulated inside the suction channel. The prevailing air stream in the flow channel can therefore be individually adapted. An air current is advantageously only then generated when the yarn end section is to be removed. In the normal spinning process, the valve is closed, or the flow diverter is moved accordingly until an energy-consuming air current no longer prevails within the suction channel.

It is also advantageous when the spinning station comprises a withdrawal device for the withdrawal of the yarn from the spinning device, wherein the yarn end removal takes place between the outlet of the spinning device and the withdrawal device. The named area is usually easily accessible, so that a robot or a member of the service personnel can reliably grip the yarn end and fed to the piecing process, in which the yarn end is joined to the fibre material coming from the feeding device, prior to the continuation of the actual spinning process.

There are also advantages when the yarn is fixed with the aid of the yarn end disposal means and/or the withdrawal device, e.g. its withdrawal roller pair after the separation of the end section of the yarn, until it is taken over manually or with the aid of a service robot and fed to the piecing process. The search for the yarn end is omitted in this case, so that the time required for the piecing process can be further reduced.

There are also advantages when the end section of the yarn to be removed is wound off the bobbin of the winding device in that a bobbin drive is driven in the opposite direction to the winding on direction, which prevails during the spinning process. This results in a controlled winding off process, which can prevent looping formation or other undesirable reductions in yarn tension. In this case, for example, the bobbin can be driven directly. A drive via a winding roller, which is disposed on the surface of the bobbin and effects an indirect drive, is of course also possible.

It is also advantageous when the winding device includes a yarn-traversing device and a yarn lifting arrangement is assigned to the yarn-traversing device, wherein the yarn is removed from the effective area of the yarn-traversing device with the aid of the yarn raising arrangement at least during the winding off of the end section of the yarn to be removed. While during the process the traversing device provides that the produced yarn is deposited in the known way on the bobbin, contact between the traversing device and the yarn during the winding off process is undesirable in order to avoid damage to the yarn and/or the traversing device. This can be achieved in a simple way by means of the yarn-lifting device in such a way that the yarn in the area of the traversing device is moved only so far away as that no contact occurs with the traversing device.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
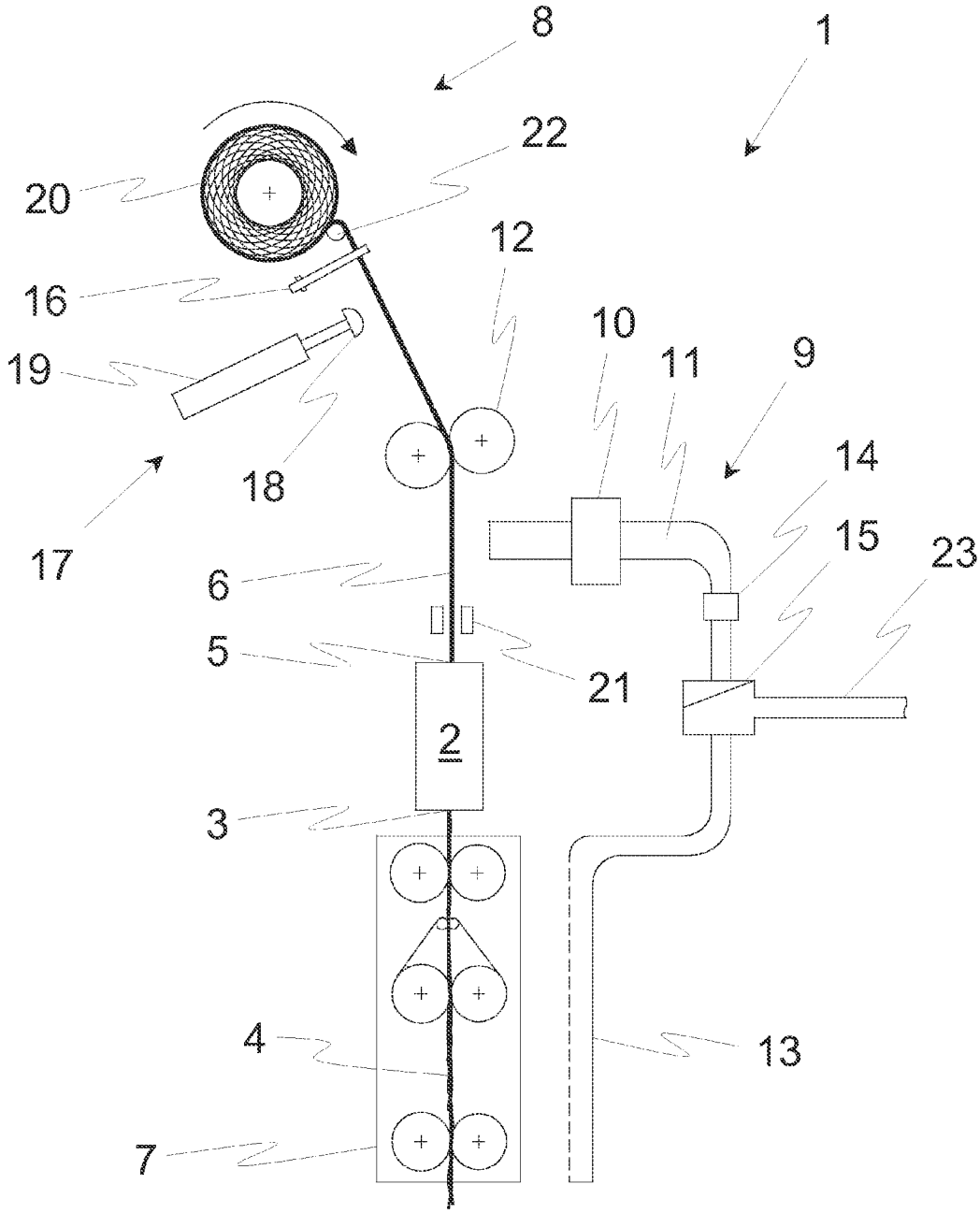
FIG. 1 shows a schematic side view of an air jet spinning machine according to the present invention during the spinning process.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic side view of a spinning station 1 of an air jet spinning machine (as an exemplary spinning machine according to the present invention) during the spinning process, wherein the air jet spinning machine generally includes a number of spinning stations 1 advantageously of identical assembly and arranged one behind the other perpendicular to the drawing plane.

In the example shown in FIG. 1, the air jet spinning machine comprises a feed device 7 designed as a drafting unit, which is supplied with a fibre material 4, for example in the form of a double sliver. The shown spinning station 1 comprises further a spinning device 2 at a distance from the feed device 7 comprising an inlet 3 for the fibre material 4 and an inner air vortex chamber (not shown).

Within the air vortex chamber, the fibre material 4, or respectively, at least a part of the fibres of the fibre material 4 for production of the selected yarn 6 is provided with a twist in the known way. The twist occurs herein by means of a selected air stream in the area of a spindle tip, wherein the airstream is generated by means of air jets tangentially running into the air vortex chamber.

The shown spinning station 1 further comprises a withdrawal device 12 formed by a withdrawal roller pair, as well as a winding device 8 for winding on the withdrawn yarn 6 which is withdrawn through the outlet 5 from the spinning station 1, the winding device 8 being arranged downstream of the withdrawal roller pair and comprising an exchangeable bobbin 20.

Furthermore, the spinning machine can be equipped with a yarn monitoring unit 21, which monitors predetermined parameters of the yarn 6 (for example the yarn thickness, the yarn strength, or other parameters representative of the quality of the yarn 6 and/or the presence of the yarn 6 at the respective position. The yarn monitoring unit 21 is advantageously a non-contact device.

The arrangement according to other embodiments of the present invention does not need to include a drafting unit, as is shown in FIG. 1. The withdrawal roller pair is also not absolutely necessary. The spinning machine can be designed as a rotor spinning machine, wherein the spinning device 2 in this case includes a rotor and the feed device (instead of the drafting unit of a feed) includes an opening roller.

The figures also show, in addition to the above-mentioned components, a winding roller 22, by means of which the bobbin 20 can be set in rotational motion. A yarn-traversing device 16 (for example in the form of flyer traversing device) is also present, with the aid of which the yarn 6 is moved to and fro in a direction perpendicular to the drawing plane during the winding onto the bobbin 20, so that a one-sided winding of the yarn is avoided.

The components essential for the process according to the present invention are disclosed in detail in the following.

In the event of the yarn monitoring unit 21 (which can also be positioned at another position) detecting a defined deviation in the monitored yarn parameter or parameter from the set value, or as soon as a doffing process is to take place, the transport speeds of the feed device 7, the withdrawal device 12 and the winding device 8 will be gradually reduced. A reduction in speed can also take place before the spinning machine is stopped.

Reduction in speed does herein not necessarily take place simultaneously or continuously. In any case, the individual transport speeds should be slowed down in such a way that the spinning process can continue for as long as possible. Uncontrolled breaking of the yarn 6 can be avoided in this way. Rathermore, the aim of reduction in transport speeds is to bring the stable spinning process to a standstill by falling below predetermined transport speeds, so that from a certain station in time, no more yarn 6 is generated from the fibre material 4. At this station in time, the desired interruption of the yarn production is effected, in which the yarn 6 is released from the fibre material 4 without an additional acting force. This can for example be achieved in that transport speeds of the feed device 7 are reduced to such an extent that no sufficient amount of fibre material 4 is fed to form a yarn 6.

Figure 2:
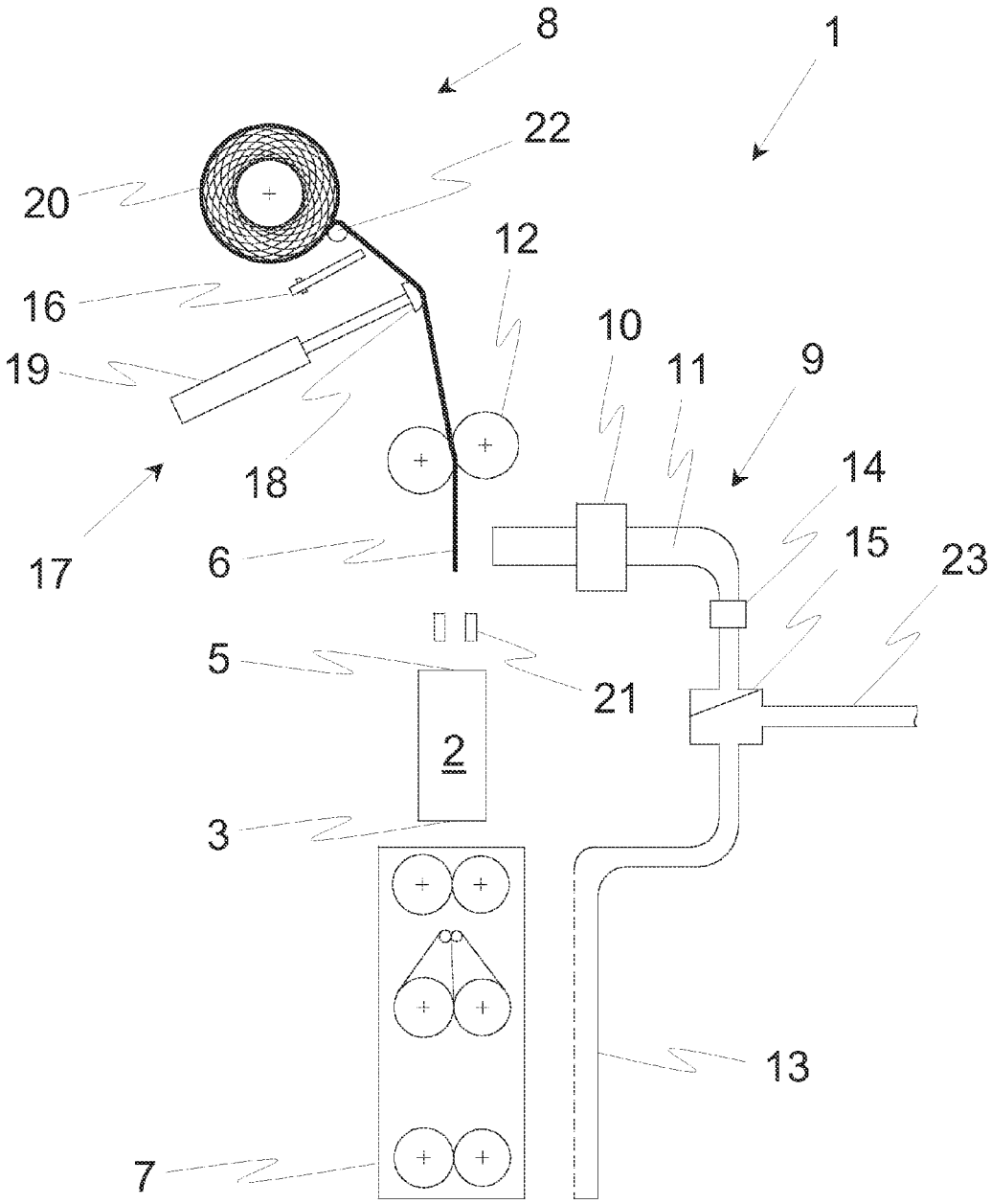
FIG. 2 shows a schematic side view of an air jet spinning machine according to an embodiment of the present invention subsequent to an interruption in the spinning process.

After yarn production has been interrupted, the withdrawal roller pair can be further operated for a short space of time, until the occurring end of the yarn 6 takes up a pre-defined position subsequent to the final standstill of the feed device 7, the withdrawal device 12, and the winding device 8, as shown in FIG. 2.

In order to stop the withdrawal device 12, or respectively, the winding device 8 at the correct station in time, it may be advisable to equip the spinning machine with a sensor, which for example can be integrated into the yarn monitoring device 21 or positioned separately. The sensor is designed to be able to detect the end of the yarn 6. When the end of the yarn 6 reaches the sensor, the withdrawal device 12 as well as the winding device 8 can, with the aid of a corresponding control or regulatory unit, be either stopped immediately or after a certain time delay, so that the end of the yarn 6 is located between the outlet 5 of the spinning station 1 and the withdrawal device 12.

The outcome is that the end of the yarn 6 necessary for the piecing process is now located at a pre-defined place between the outlet 5 of the spinning station 1 and the bobbin 20 of the winding device 8, so that the process according to the present invention can begin without a search action for the end of the yarn 6, for example on the surface of the bobbin 20 of the winding device 8. It is self-evident that an alternative to the process according to the present invention is possible, namely with the aid of an additional yarn handling arrangement which grips the yarn end on the bobbin surface and moves it to the area of the yarn end disposal means 9 and delivers it thereto, the yarn end disposal means being described below.

As can be seen in the overview of FIGS. 1 and 2, the spinning station 1 comprises a yarn end disposal means 9. In the shown embodiment, the disposal means includes a suction channel 11, which for example is connected via a flow diverter 15 or also directly (not shown) with a section of a suction installation 23 of the spinning machine. The flow diverter 15 can further be coupled with the suction device 13 of the feed device 7, as is shown in the figures. By re-directing the flow diverter 15, it is possible to subject the suction device 13 of the feed device 7 to low pressure during the normal spinning process, while in the course of the removal (as described below) of the end section of the yarn 6 (for example after a quality cut), the suction channel 11 is connected to the suction installation 23, with simultaneous deactivation of the suction device 13 of the feeding device 7. In addition, it is also possible as an alternative to equip the suction channel 11 with a valve 14, with the aid of which a regulation of the air volume flow within the suction channel 11 is also possible.

The suction channel 11 should be subjected to low pressure in any case, as soon as the spinning process ends and the yarn end is located in a position as shown in FIG. 2. The roller pair of the withdrawal device 12, as well as the bobbin 20, is driven simultaneously or time-delayed in the opposite direction to the rotational direction prevailing during the spinning process (see rotation arrow in FIG. 1), so that the yarn 6 can be wound off the bobbin 20 again (for this purpose, the withdrawal device 12 and the winding device 8 advantageously comprise single drives in order to effect the reverse rotation direction).

Furthermore, in order to prevent a collision of the yarn 6 with the yarn-traversing device 16, it is advisable to assign a yarn-lifting device 17 to the yarn 6 in this area, which yarn-lifting device 17 may include for example a lifting element 18 extending over the width area of the bobbin 20, and also a pneumatic cylinder 19 which is connected to the lifting element 18. As can be seen in FIG. 2, the yarn 6 is moved as far in the opposite direction of the yarn-traversing device 16 until the yarn 6 can no longer reach the effective area of the yarn-traversing device 16 (see FIGS. 2 and 4).

The yarn 6 is wound off from the bobbin 20 until the end section of the yarn 6, unsuitable for a subsequent piecing process, is located inside the suction channel 11. The length of the yarn 6 can herein for example measure a pre-defined corresponding length, which is calculated by a sensor or via the number of revolutions of the bobbin 20, or respectively, the roller of the withdrawal device 12. If the yarn production is interrupted by a slowing down of the feed speeds, as described above, it is practical to remove at least the section which is produced during slowing down, as the quality mostly does not meet requirements.

Figure 3:
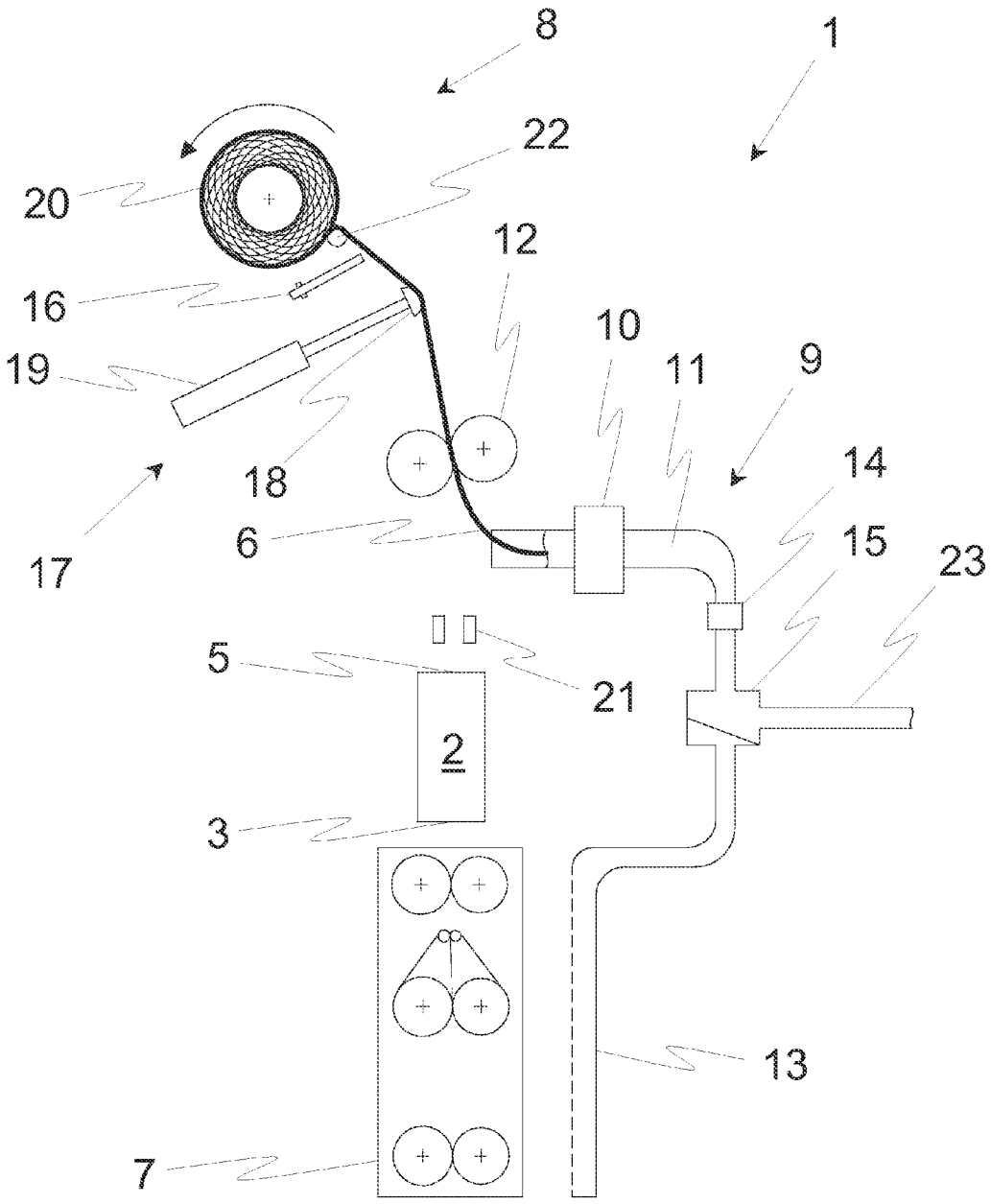
FIG. 3 shows a schematic side view of an air jet spinning machine according to an embodiment of the present invention during removal of the end section of the yarn.

The course of the yarn 6 subsequent to the above-mentioned suctioning of the end section is shown in FIG. 3. If the entire section to be removed is sucked into the suction channel 11, the section is separated from the yarn. This, for example, can be carried out with the aid of a cutting unit 10, which for example can be integrated into the suction channel 11 and with the aid of which the yarn end to be removed is cut off from the rest of the yarn 6.

Figure 4:
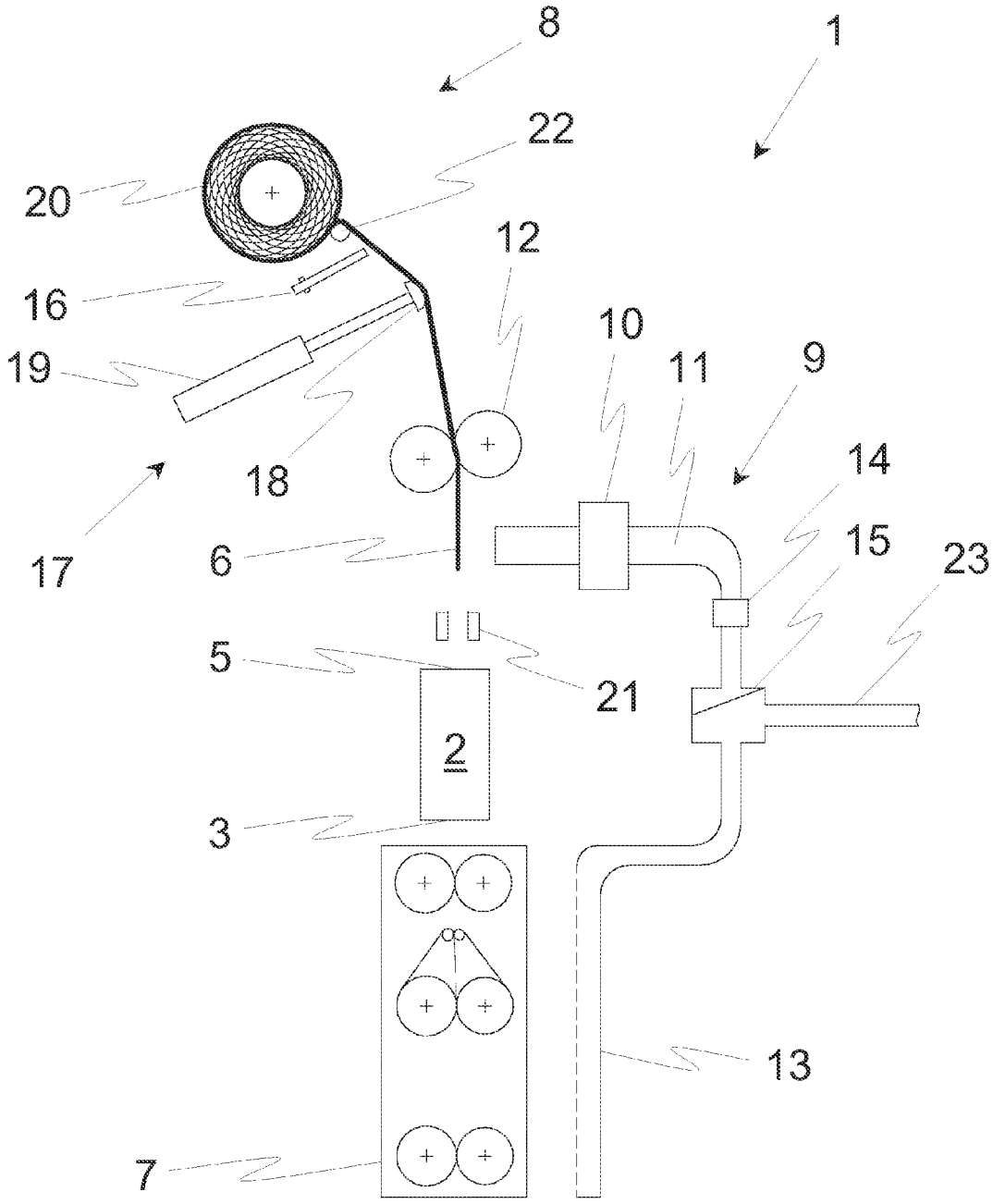
FIG. 4 shows a schematic side view of an air jet spinning machine according to an embodiment of the present invention subsequent to the removal of the yarn end section.
Figure 5:
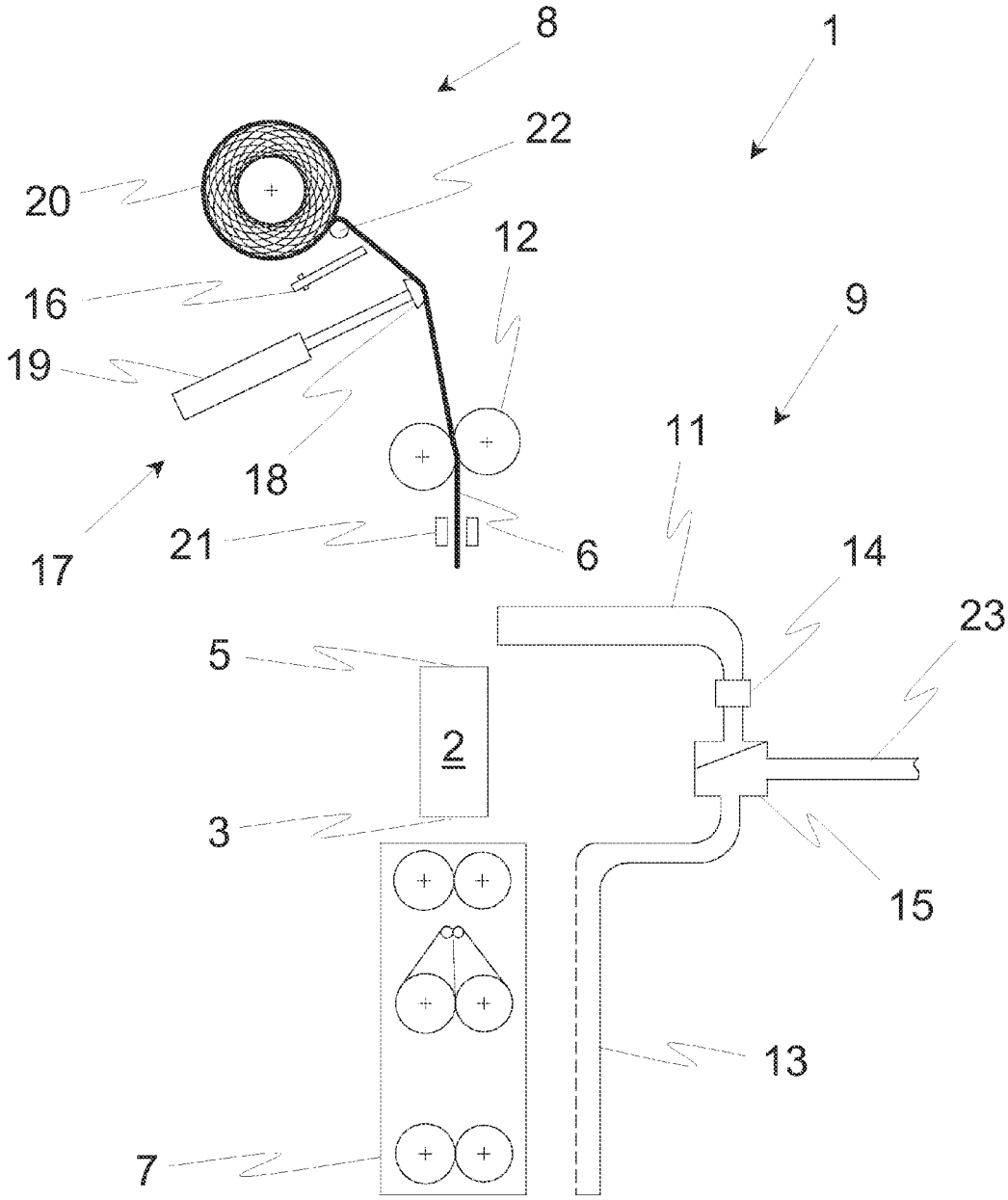
FIG. 5 shows a schematic side view of a further embodiment of an air jet spinning machine according to an embodiment of the present invention.

With regard to the cutting unit 10, it is of course also possible to integrate the cutting unit 10 into the yarn-monitoring unit 21. The yarn monitoring unit 21 should in this case be positioned, counter to the positioning as shown in FIGS. 2 to 4, between the suction channel 11 and the withdrawal device 12. This position is shown in FIG. 5. As a result, and if required, a separate cutting unit 10 can be omitted within the yarn end disposal means 9 or, respectively, within the suction channel 11.

Subsequent to the cutting of the end section from the yarn 6, the yarn end disposal means 9 is deactivated again, that is, the valve 14 is closed, the flow diverter is adjusted in support of the suction device 13 and/or the airstream within the suction channel 11 is interrupted by means of deactivating the suction installation 23.

For the subsequent piecing process in accordance with FIG. 4, the yarn end, which continues to be fixed by the withdrawal device 12 and which is released from the yarn end disposal means 9, is moved with the aid of a service robot, or a yarn handling device of the spinning station, or is also manually gripped and, for example, counter to the actual spinning direction in the spinning station 1, is moved between the inlet 3 of the spinning station 1 and the feed device 7, or between adjacent roller pairs of the feed device 7. The yarn end is then brought into contact with the fibre material 4 and re-introduced into the spinning station 1. The spinning process begins again.

Figure 6:
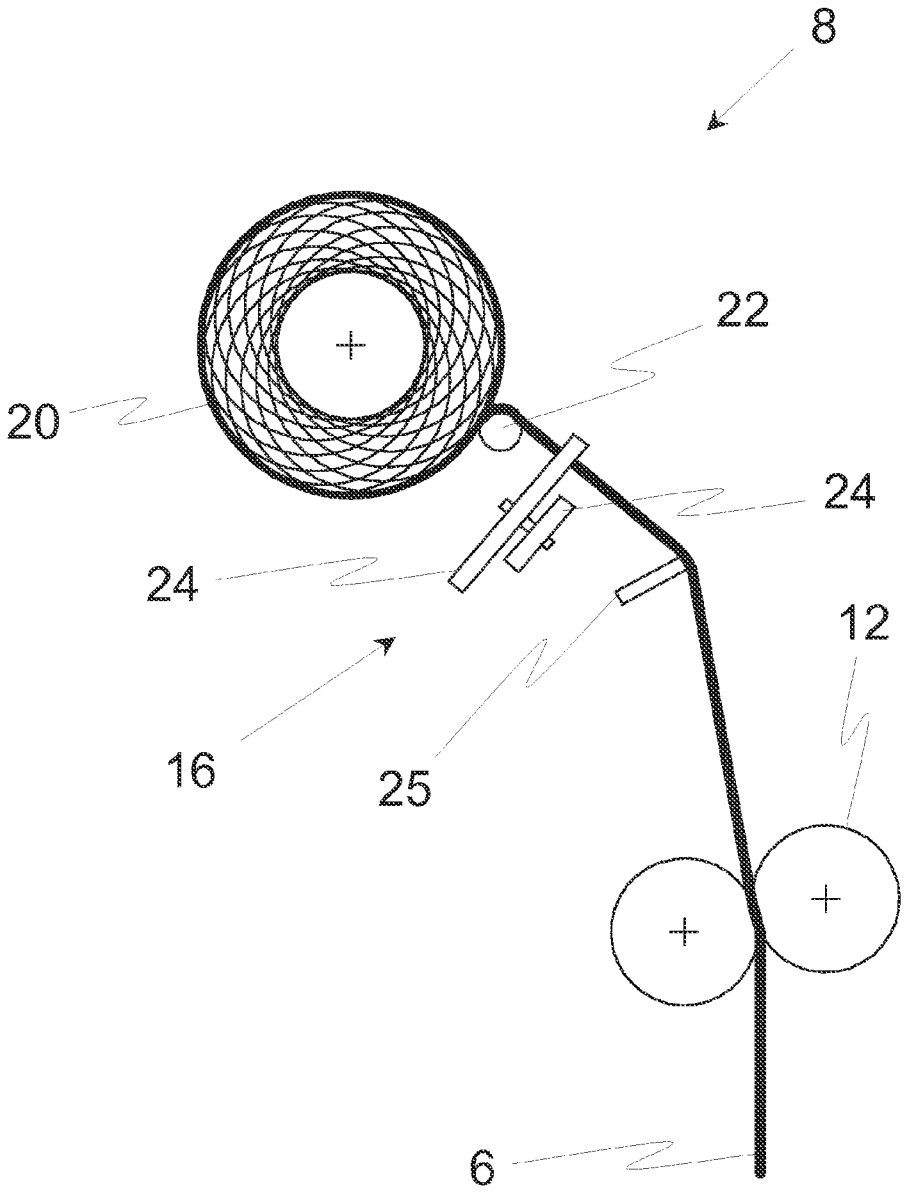
FIG. 6 shows the winding-on area of a spinning machine according to an embodiment of the present invention in a side view.
Figure 7:
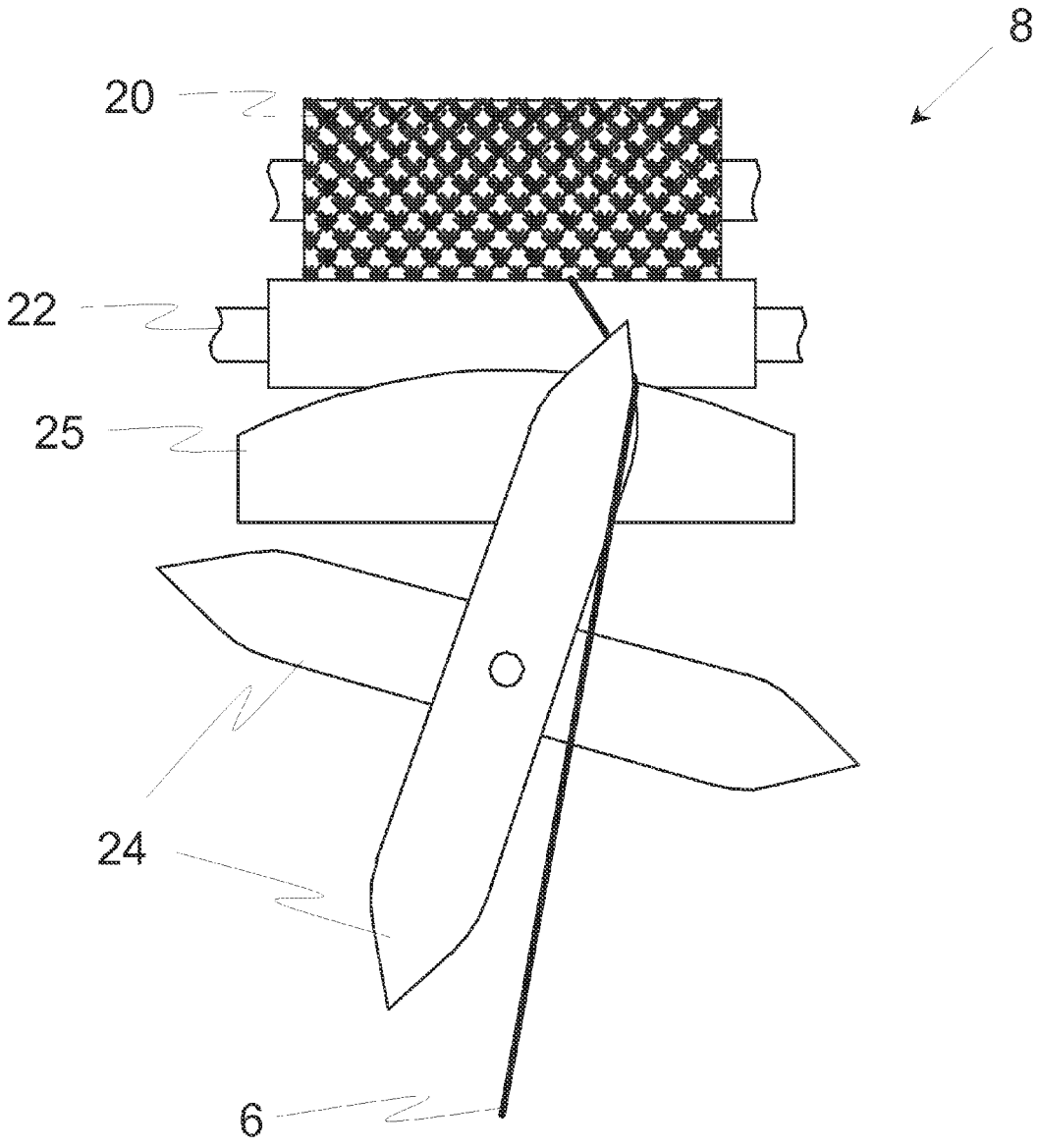
FIG. 7 shows the area according to FIG. 6 in a frontal view.

FIGS. 6 and 7 show a further alternative of a traversing device 16. The traversing device 16 comprises in this case two traversing elements 24 (also: flyer traversing device) rotatable in opposite directions to one another around a joint rotational axis. During the winding of the yarn 6 onto the bobbin 20 of the winding device 8, each of the two traversing elements 24 come alternately into contact with the yarn 6 and move it (related to FIG. 7) from right to left (and in reverse) in order to ensure the desired traverse motion, that is, the sideways movement of the yarn 6, which is guided additionally in its movement by means of a deflecting element 25.

If prior to the piecing, a part of the yarn 6 already wound onto the bobbin 20 is wound off again (as described above), it is advantageous when the traversing element 24 is for example brought into a position which the essentially horizontally positioned traversing element 24 takes up in FIG. 7. As contact between the yarn 6 and the traversing elements 24 is excluded in this position, no reciprocal adverse effects during the desired winding process can occur. As soon as the yarn 6 is again wound onto the bobbin 20, the traversing elements 24 rotate again in the above-mentioned opposite directions and effect the desired traversing motion of the yarn 6.

Furthermore, the present invention is not limited to the embodiments disclosed. Rathermore, all combinations of the above described individual features, as described in the claims and the description, and as shown or described in the Figures and insofar as a technical combination is possible, or respectively, appears practical, are an object of the present invention. The yarn-lifting device, as it is shown in the Figures, is not absolutely necessary, depending on the applied yarn-traversing device. The suction channel need not comprise a valve, or be coupled via a flow diverter with the suction installation of the feed device. Rather a direct connection of the suction channel with a vacuum source or a corresponding flow device is possible.

The invention claimed is:

1. A spinning machine, comprising:

a spinning station, said spinning station further comprising a spinning device having an inlet for fiber material and an outlet for yarn produced by said spinning device;

a feeding device configured to feed fiber material to said spinning device;

a winding device configured to wind the yarn produced by said spinning device;

a yarn end disposal mechanism operably disposed and configured to separate and remove an end section of the produced yarn between said outlet of said spinning device and said winding device; and wherein said winding device comprises a yarn traversing device, said yarn traversing device comprising a lifting device configured to move the produced yarn out of effective range of said yarn traversing device during a piecing process.

2. The spinning machine as in claim 1, wherein said yarn end disposal mechanism comprises a suction channel disposed so as to suck in the end section of the yarn to be separated.

3. The spinning machine as in claim 2, further comprising a cutting device disposed to separate the end section of the yarn from the produced yarn.

4. The spinning machine as in claim 3, wherein said cutting device is disposed within said suction channel.

5. The spinning machine as in claim 3, further comprising a withdrawal device operably disposed to withdraw the yarn produced by said spinning device, and a yarn monitoring unit operably disposed between said withdrawal device and said suction channel, said cutting device configured with said yarn monitoring unit.

6. The spinning machine as in claim 1, further comprising a withdrawal device operably disposed to withdraw the yarn produced by said spinning device, said yarn end disposal mechanism configured between said outlet of said spinning device and said withdrawal device.

7. The spinning machine as in claim 6, wherein at least one of said withdrawal device or said winding device comprises a reversible driving unit.

8. The spinning machine as in claim 1, comprising a plurality of said spinning stations arranged adjacently along said spinning machine, each said spinning station comprising a respective said yarn end disposal mechanism.

9. The spinning machine as in claim 1, wherein said yarn end disposal mechanism comprises a suction channel disposed so as to suck in the end section of the yarn to be separated, said feed device further comprising a suction device connected to said suction channel.

10. The spinning machine as in claim 9, wherein said suction channel comprises one of a valve or flow diverter to regulate air pressure within said suction channel.

11. The spinning machine as in claim 1, wherein said lifting device comprises a lifting element actuated by a pneumatic cylinder to move relative to the produced yarn.

12. The spinning machine as in claim 11, wherein said lifting element extends over a width of said winding device.

13. A spinning machine, comprising:

a spinning station, said spinning station further comprising a spinning device having an inlet for fiber material and an outlet for yarn produced by said spinning device;

a feeding device configured to feed material to said spinning device;

a winding device configured to wind the yarn produced by said spinning device;

a yarn end disposal mechanism operably disposed and configured to separate and remove an end section of the produced yarn between said outlet of said spinning device and said winding device; and wherein said winding device comprises a yarn traversing device, said yarn traversing device comprising a traversing element that contacts the produced yarn during a yarn spinning process, said traversing element movable to a position wherein said traversing element is not in contact with the produced yarn during winding off of the yarn from said winding device during a piecing process.

14. A process for removing an end section of a yarn at a spinning station of a spinning machine prior to a piecing process, comprising:

subsequent to an interruption of a yarn spinning process at the spinning station, winding off an end section of the yarn from a winding device; and at a location between an outlet of a spinning device and the winding device, gripping the end section of the yarn with a yarn end disposal mechanism, and separating and removing the end section of the yarn from the spinning station; and wherein the winding device includes a traversing device and a yarn lifting device, the process further comprising moving the yarn out of effective range of the traversing device with the yarn lifting device during winding off the end section of the yarn.

15. The process as in claim 14, wherein the spinning station includes a feed device for feeding fiber material to the spinning device, and a withdrawal device for withdrawing the yarn from the spinning device, the process comprising gradually reducing the transport speeds of the feed device, withdrawal device, and the winding device to a standstill prior to winding off of the end section of the yarn, the speed reduction performed such that the end section of the yarn is located between an outlet of the spinning device and the winding device subsequent to the standstill.

16. The process as in claim 15, further comprising sucking in and removing the end section of the yarn with a suction channel of the yarn end disposal mechanism.

17. The process as in claim 16, further comprising regulating air pressure within the suction channel with a valve or flow diverter within the suction channel.

18. The process as in claim 15, wherein removal of the end section of the yarn takes place between the outlet of the spinning device and the withdrawal device.

19. The process as in claim 18, comprising fixing the yarn in position after separation and removal of the end section of the yarn prior to the yarn being taken for a piecing process.

20. The process as in claim 14, wherein the winding device includes a bobbin having a reversible drive, the process further comprising driving the bobbin in an opposite direction relative to the spinning process to wind off the end section of the yarn.

21. A process for removing an end section of a yarn at a spinning station of a spinning machine prior to a piecing process, comprising:

subsequent to an interruption of a yarn spinning process at the spinning station, winding off an end section of the yarn from a winding device; and at a location between an outlet of a spinning device and the winding device, gripping the end section of the yarn with a yarn end disposal mechanism, and separating and removing the end section of the yarn from the spinning station; and wherein the winding device comprises a yarn traversing device, the yarn traversing device comprising a traversing element that contacts the produced yarn during a yarn spinning process, the process further comprising moving the traversing element to a position wherein the traversing element is not in contact with the produced yarn during winding off of the yarn from the winding device during the piecing process.

* * * * *